US010546701B2

(12) United States Patent
Tanigaki et al.

(10) Patent No.: US 10,546,701 B2
(45) Date of Patent: Jan. 28, 2020

(54) OPERATING DEVICE AND CIRCUIT BREAKER

(71) Applicant: Mitsubishi Electric Corporation, Chiyoda-ku, Tokyo (JP)

(72) Inventors: Shuichi Tanigaki, Tokyo (JP); Daisuke Fujita, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 16/320,650

(22) PCT Filed: Aug. 1, 2016

(86) PCT No.: PCT/JP2016/072540
§ 371 (c)(1),
(2) Date: Jan. 25, 2019

(87) PCT Pub. No.: WO2018/025311
PCT Pub. Date: Feb. 8, 2018

(65) Prior Publication Data

US 2019/0157016 A1 May 23, 2019

(51) Int. Cl.
*H01H 3/30* (2006.01)
*H01H 33/40* (2006.01)
*H01H 33/42* (2006.01)

(52) U.S. Cl.
CPC ..... *H01H 3/3042* (2013.01); *H01H 33/40* (2013.01); *H01H 33/42* (2013.01)

(58) Field of Classification Search
CPC ..... H01H 3/3042; H01H 3/30; H01H 1/14; H01H 33/40; H01H 33/42
(Continued)

(56) References Cited

U.S. PATENT DOCUMENTS 3,190,983 A 6/1965 Karel
3,241,620 A * 3/1966 Brudnak, Jr. ..... A01B 63/112 172/7
(Continued)

FOREIGN PATENT DOCUMENTS

JP S59025120 U1 2/1984
JP S63304542 A 12/1988
(Continued)

OTHER PUBLICATIONS

International Search Report (with English translation) and Written Opinion issued in corresponding International Patent Application No. PCT/ PCT/JP2016/072540, dated Oct. 25, 2016, 9 pages.
(Continued)

*Primary Examiner* — Edwin A. Leon
*Assistant Examiner* — William A Bolton
(74) *Attorney, Agent, or Firm* — Buchanan Ingersoll & Rooney PC

(57) ABSTRACT

An operating device includes: a first lever rotatable around a rotation axis; a torsion bar having a columnar shape or a tubular shape with the rotation axis as a central axis and connected to the first lever; and a support that fixes and supports one end of the torsion bar. Further, the operating device includes: a drive shaft having a tubular shape with the rotation axis as a central axis and surrounding a periphery of the torsion bar, one end serving as the first lever side being connected to the first lever, and another end opposite to the one end serving as the first lever side being rotatably supported around the rotation axis; and a plurality of second levers connected to the drive shaft and rotatable around the rotation axis on the support side rather than the first lever.

6 Claims, 9 Drawing Sheets

(58) Field of Classification Search
USPC ..... 200/400, 426, 17 R, 153 SC; 218/51, 56, 218/57, 59, 60
See application file for complete search history.

(56) References Cited

U.S. PATENT DOCUMENTS 3,316,366 A * 4/1967 Siviy ..... H01H 31/28 200/48 R
4,302,646 A * 11/1981 Osborne ..... H01H 33/121 200/318
4,839,476 A 6/1989 Okuno
6,232,569 B1 * 5/2001 Nakajima ..... H01H 3/3042 200/17 R
6,444,934 B1 * 9/2002 Imura ..... H01H 3/3042 200/17 R
6,610,949 B2 * 8/2003 Mori ..... H01H 3/3015 200/400
2009/0173611 A1 * 7/2009 Suter ..... H01H 3/3026 200/336

FOREIGN PATENT DOCUMENTS

JP S64020635 U 2/1989
JP H10321088 A 12/1998
JP H11053998 A 2/1999
JP 2015008592 A 1/2015

OTHER PUBLICATIONS

Notification of Reasons for Refusal (with English translation) issued in Japanese Patent Application No. 2017-510431, dated Jun. 13, 2017, 5 pages.
Extended European Search Report dated Jul. 3, 2019 for corresponding European Patent Application No. 16911572.2, 11 pages.

* cited by examiner

OPERATING DEVICE AND CIRCUIT BREAKER

FIELD

The present invention relates to an operating device that opens and closes a contact by using energy stored by torsion of a torsion bar and a circuit breaker including the operating device.

BACKGROUND

It is known that an operating device that opens and closes a contact of a circuit breaker installed in a substation or a switching station includes a torsion bar, as disclosed in Patent Literature 1. In such an operating device, opening and closing operation of the contact is performed by using energy stored by torsion applied to the torsion bar.

CITATION LIST

Patent Literature

Patent Literature 1: Japanese Patent Application Laid-Open No. S63-304542

SUMMARY

Technical Problem

The circuit breaker has a tank containing the contact inside and a sealed insulating gas, and the operating device is attached to an end surface of the tank. Also, since a lever of the operating device is connected to the contact, the operating device is generally provided so that the lever is located on the end surface of the tank. In the above conventional operating device, an amount of protrusion of the torsion bar out of the tank is increased, resulting in problems of increasing a size of the circuit breaker and complicating a structure due to addition of a support structure for supporting the torsion bar. Particularly, when the operating device is attached to a three-phase separation type circuit breaker in which three-phase circuits are housed in separate tanks, the device tends to become larger to secure a space for the torsion bar protruding from the operating device attached to each of the tanks.

The present invention has been made in view of the above, and an object thereof is to obtain an operating device that can contribute to miniaturization of a circuit breaker and simplification of a structure.

Solution to Problems

In order to solve the above-mentioned problems and achieve the object, an operating device includes: a first lever rotatable around a rotation axis; a torsion bar having a columnar shape or a tubular shape with the rotation axis as a central axis and connected to the first lever; and a support that fixes and supports one end of the torsion bar. In addition, the operating device includes: a drive shaft having a tubular shape with the rotation axis as a central axis and surrounding a periphery of the torsion bar, one end serving as the first lever side being connected to the first lever, and another end opposite to the one end serving as the first lever side being rotatably supported around the rotation axis; and a plurality of second levers connected to the drive shaft and rotatable around the rotation axis on the support side rather than the first lever.

Advantageous Effects of Invention

According to the present invention, it is possible to obtain an operating device which can contribute to miniaturization of a circuit breaker and simplification of a structure.

DESCRIPTION OF EMBODIMENT

Hereinafter, an operating device and a circuit breaker according to an embodiment of the present invention will be described in detail with reference to the drawings. It should be noted that the present invention is not limited by this embodiment.

First Embodiment

Figure 1:
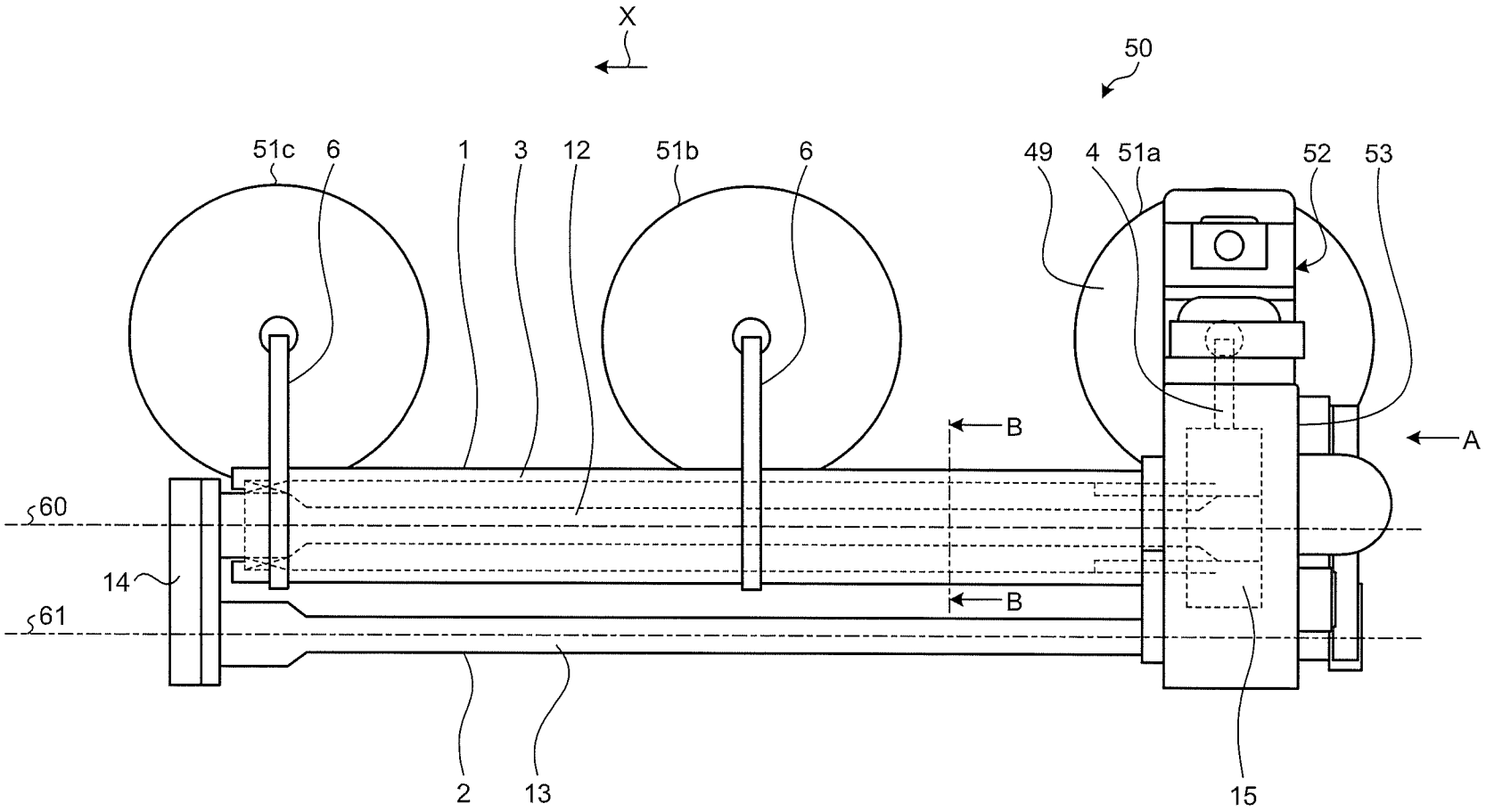
FIG. 1 is a plan view of a circuit breaker according to a first embodiment of the present invention.
Figure 2:
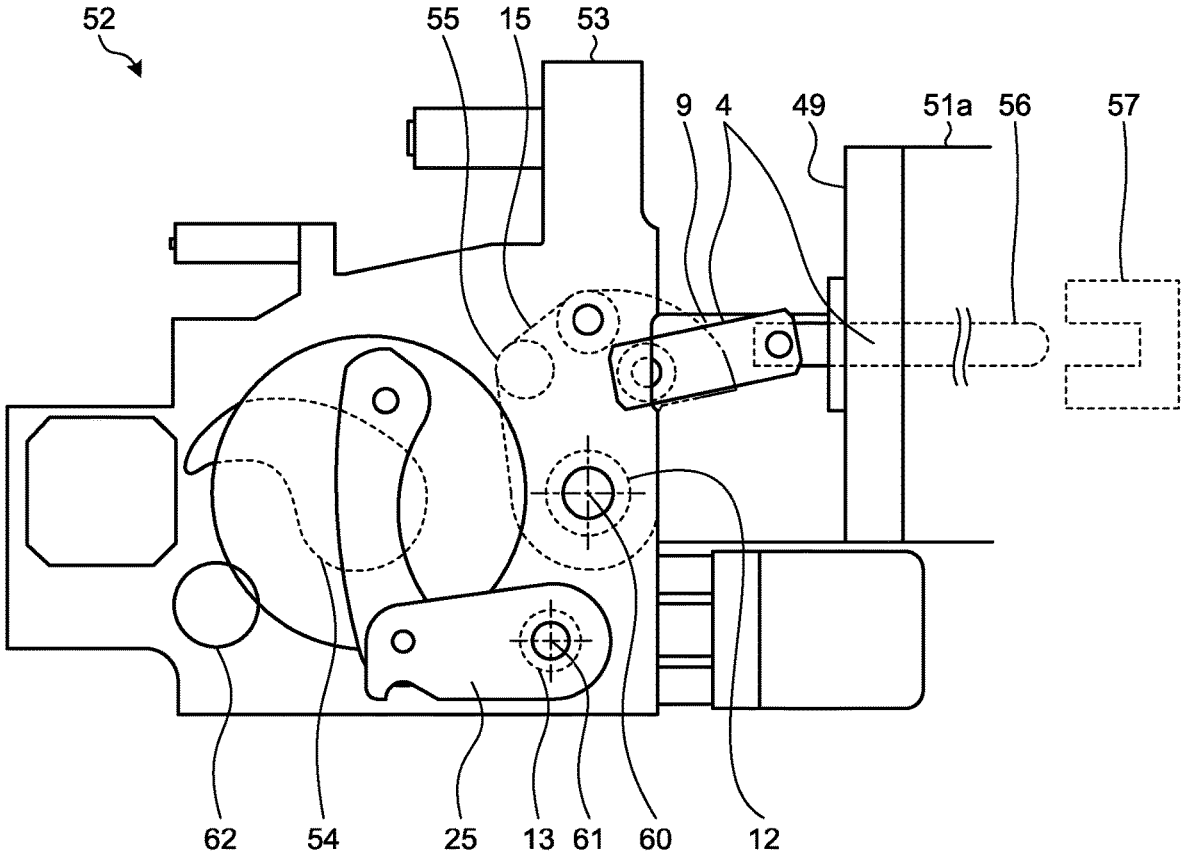
FIG. 2 is a side view of the circuit breaker according to the first embodiment as seen along an arrow A.
Figure 3:
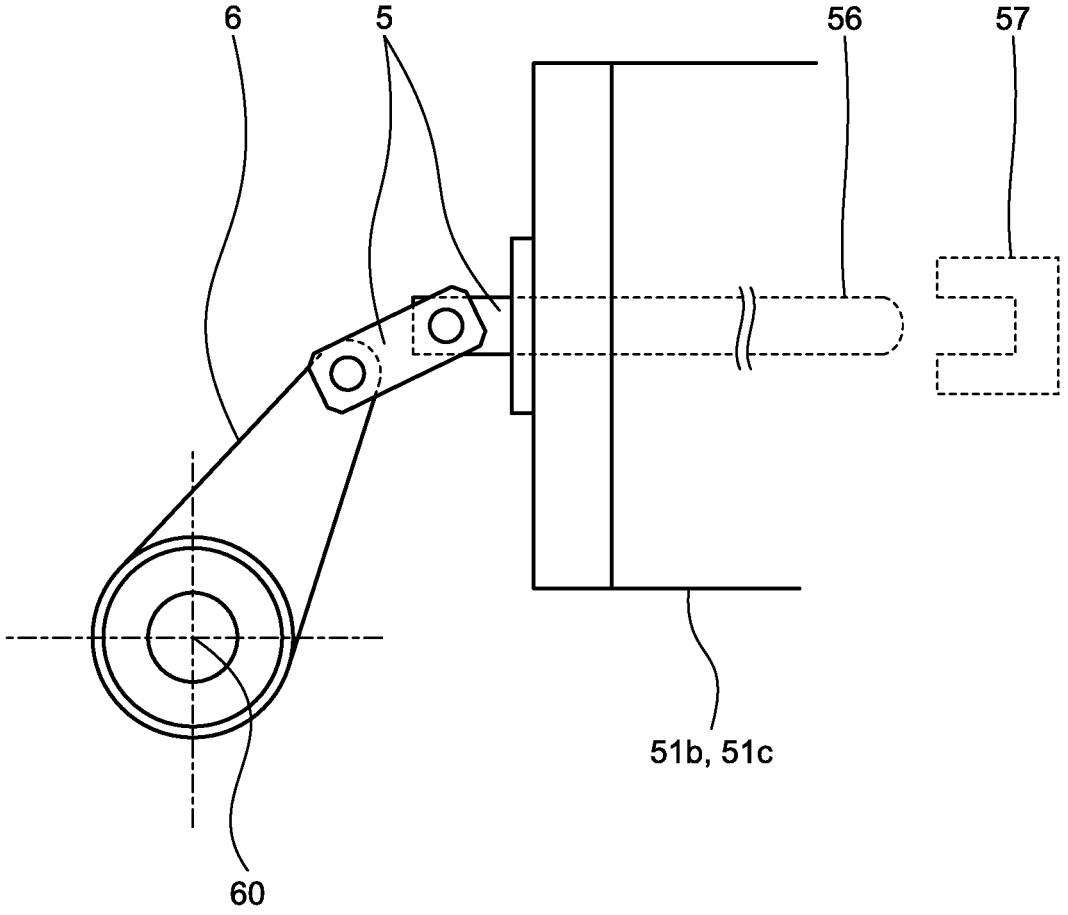
FIG. 3 is a cross-sectional view taken along a line B-B illustrated in FIG. 1.

FIG. 1 is a plan view of a circuit breaker according to a first embodiment of the present invention. FIG. 2 is a side view of a circuit breaker 50 according to the first embodiment as viewed along an arrow A. FIG. 3 is a cross-sectional view taken along a line B-B illustrated in FIG. 1.

The circuit breaker 50 includes three tanks 51*a* to 51*c* in which an insulating gas is sealed. The three tanks 51*a* to 51*c* are disposed linearly as illustrated in FIG. 1. An operating device 52 is attached to an end surface 49 which is a top face of the tank 51*a* provided at an end.

The operating device 52 includes a housing 53 fixed to the end surface 49 of the tank 51 via a mounting seat 9, an opening torsion bar 1 extending from the housing 53 along a first direction indicated by an arrow X, a closing torsion bar 2 extending from the housing 53 along the direction indicated by the arrow X, and a support 14 provided so as to face the housing 53.

Figure 4:
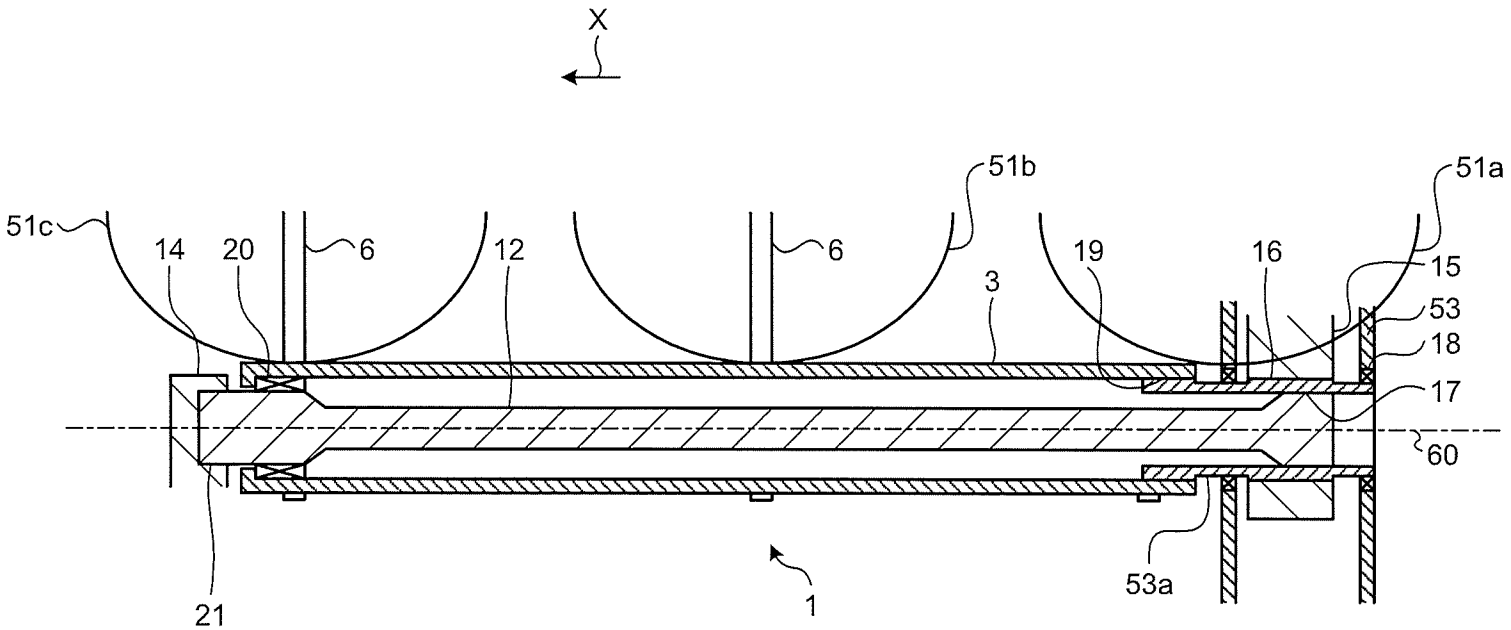
FIG. 4 is a plan sectional view of an opening torsion bar portion of an operating device according to the first embodiment.

FIG. 4 is a plan sectional view of the opening torsion bar 1 portion of the operating device 52 according to the first embodiment. A through hole 53*a* penetrating along the direction indicated by the arrow X is formed in the housing 53 of the operating device 52. In the through hole 53*a*, an opening shaft 16 is supported so as to be rotatable around a rotation axis 60 via a bearing 18. The opening shaft 16 has a tubular shape with the rotation axis 60 as a central axis.

An output lever 15 serving as a first lever is connected to the opening shaft 16. The output lever 15 is rotatable around the rotation axis 60 together with the opening shaft 16. Further, the output lever 15 is housed inside the housing 53. As illustrated in FIG. 2, the output lever 15 is connected to a movable contact 56 via a link mechanism 4. The movable contact 56 is housed inside the tank 51*a*. As the output lever 15 rotates, the movable contact 56 moves. The movable contact 56 moves between a position where the movable contact 56 comes into contact with a fixed contact 57 provided in the tank 51*a* and a position where the movable contact 56 is separated from the fixed contact 57. The movable contact 56 and the fixed contact 57 constitute a circuit contact that can come into and out of contact with each other. Note that the fixed contact 57 is also housed inside the tank 51*a*. Further, the circuit contact having the movable contact 56 and the fixed contact 57 is also provided inside the tank 51*b* and inside the tank 51*c*. The circuit breaker 50 is a three-phase separation type circuit breaker in which a circuit contact is provided inside each of the tanks 51*a* to 51*c*. It should be noted that a so-called three-phase batch type circuit breaker in which three circuit contacts are housed in one tank may be used.

A torsion bar 12 is connected to the opening shaft 16. Specifically, the opening shaft 16 and the torsion bar 12 are connected by a contact part 17 where an inner peripheral surface of the opening shaft 16 and an outer peripheral surface of the torsion bar 12 are in contact. In this configuration, it can be said that the output lever 15 and the torsion bar 12 are connected via the opening shaft 16.

The torsion bar 12 has a columnar shape extending from the opening shaft 16 in the direction indicated by the arrow X with the rotation axis 60 as a central axis. Further, an end on the support 14 side of the torsion bar 12 is fixed to and supported by the support 14. Specifically, the end on the support 14 side of the torsion bar 12 is inserted into a recess formed in the support 14 and is connected to the support 14 by a contact part 21 where the torsion bar 12 and the support 14 contact each other.

A drive shaft 3 is connected to the opening shaft 16 on the support 14 side rather than the output lever 15. The drive shaft 3 has a tubular shape centered on the rotation axis 60. The drive shaft 3 and the opening shaft 16 are connected by a contact part 19 where an inner peripheral surface of the drive shaft 3 and an outer peripheral surface of the opening shaft 16 are in contact. The contact parts 17, 19, and 21 described above may have, for example, hexagonal or serration shapes that are engaged with each other, or may be joined by welding or the like.

The drive shaft 3 is rotatably supported on the torsion bar 12 at the end on the support 14 side via a bearing 20. As a result, in the drive shaft 3, the entire drive shaft 3 rotates in synchronization with the rotation of the output lever 15. The torsion bar 12 is longer than the drive shaft 3, and the end of the torsion bar 12 protrudes from the drive shaft 3.

Two interlocking levers 6 serving as second levers are connected to the drive shaft 3 on the support 14 side rather than the output lever 15. The interlocking lever 6 rotates in synchronization with the rotation of the drive shaft 3. As a result, the interlocking lever 6 rotates in synchronization with the rotation of the output lever 15.

As illustrated in FIG. 3, the interlocking lever 6 is connected to each of the tanks 51*b* and 51*c* via a link mechanism 5. As the interlocking lever 6 rotates in synchronization with the rotation of the output lever 15, the movable contact 56 in each of the tanks 51*b* and 51*c* moves between a position where the movable contact 56 comes into contact with the fixed contact 57 and a position where the movable contact 56 is separated from the fixed contact 57.

In the opening torsion bar 1 of the operating device 52, when the output lever 15 on a free end side rotates around the rotation axis 60, the torsion bar 12 is twisted, and energy that tries to return to an original state is stored. In the operating device 52, in a state in which the torsion bar 12 is twisted, the movable contact 56 and the fixed contact 57 come into contact in the tank 51*a*. In addition, by returning the torsion bar 12 from the twisted state to the original state, the movable contact 56 is separated from the fixed contact 57 in the tank 51*a*. By restricting the return of the torsion bar 12 from the twisted state to the original state by a latch mechanism being not illustrated, it is possible to maintain a state in which the movable contact 56 and the fixed contact 57 are in contact with each other in the tank 51*a*. In addition, by releasing restriction of the return by the latch mechanism, the torsion bar 12 returns from the twisted state to the original state, and the movable contact 56 can be separated from the fixed contact 57 in the tank 51*a*. In other words, by utilizing the energy stored by the torsion, the movable contact 56 can be moved at a high speed and separated from the fixed contact 57. At this time, since the interlocking lever 6 is connected to the drive shaft 3 rotating synchronously with the rotation of the output lever 15, the interlocking lever 6 also rotates in synchronization with the rotation of the output lever 15. Since contact and separation of the movable contact 56 and the fixed contact 57 are switched also within each of the tanks 51*b* and 51*c* by the rotation of the interlocking lever 6, the contact and separation of the movable contact 56 and the fixed contact 57 in the tanks 51*a* to 51*c* can be switched all at once by the rotation of the output lever. In other words, in one operating device 52, the contact and separation of the movable contact 56 and the fixed contact 57 in the three tanks 51*a* to 51*c* can be switched all at once.

Figure 5:
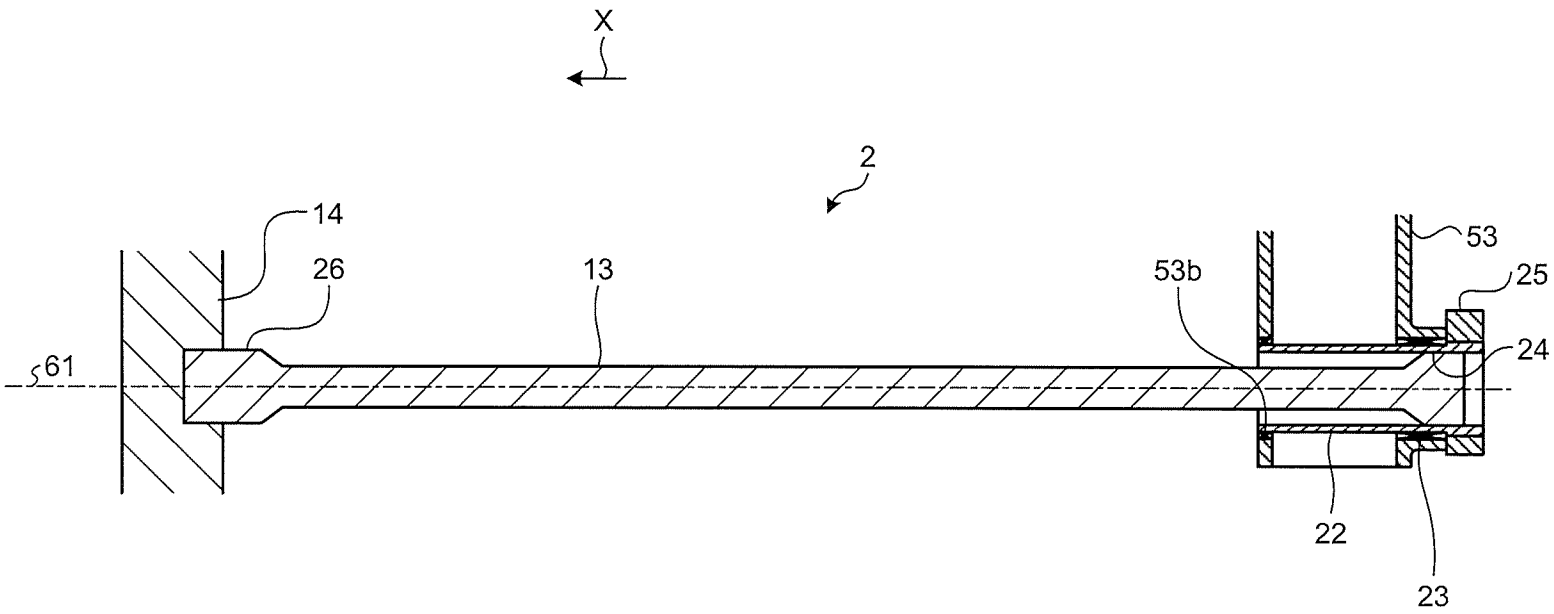
FIG. 5 is a plan sectional view of a closing torsion bar portion of the operating device according to the first embodiment.

FIG. 5 is a plan sectional view of the closing torsion bar 2 portion of the operating device 52 according to the first embodiment. A through hole 53*b* penetrating along the direction indicated by the arrow X is formed in the housing 53 of the operating device 52. A closing shaft 22 is rotatably supported around a rotation axis 61 via a bearing 23 in the through hole 53*b*. The closing shaft 22 has a tubular shape with the rotation axis 61 as a central axis.

A closing lever 25 is connected to the closing shaft 22. The closing lever 25 is rotatable around the rotation axis 61 together with the closing shaft 22. A torsion bar 13 is connected to the closing shaft 22. Specifically, the closing shaft 22 and the torsion bar 13 are connected by a contact part 24 where an inner peripheral surface of the closing shaft 22 and an outer peripheral surface of the torsion bar 13 are in contact. In this configuration, it can be said that the closing lever 25 and the torsion bar 13 are connected via the closing shaft 22.

The torsion bar 13 has a columnar shape extending from the closing shaft 22 in the direction indicated by the arrow X with the rotation axis 61 as a central axis. Further, an end on the support 14 side of the torsion bar 13 is fixed to and supported by the support 14. Specifically, the end on the support 14 side of the torsion bar 13 is inserted into a recess formed in the support 14 and is connected to the support 14 by a contact part 26 where the torsion bar 13 and the support 14 contact each other. The above-described contact parts 24 and 26 may have, for example, hexagonal or serration shapes that are engaged with each other, or may be joined by welding or the like.

In the closing torsion bar 2 of the operating device 52, when the closing lever 25 on a free end side rotates around the rotation axis 61, the torsion bar 13 is twisted, and energy to return to an original state is stored. In the operating device 52, in a process that the torsion bar 13 returns from a twisted state, a cam 54 illustrated in FIG. 2 presses an abutting part 55 of the output lever 15 to rotate the output lever 15. By restricting the return of the torsion bar 13 from the twisted state to the original state by the latch mechanism being not illustrated, a state in which the movable contact 56 is separated from the fixed contact 57 can be maintained. By releasing restriction of the return by the latch mechanism, the torsion bar 13 returns from the twisted state to the original state, and the cam 54 rotates the output lever 15, whereby the movable contact 56 can make contact with the fixed contact 57. In other words, by using the energy stored by the torsion, the movable contact 56 can be moved at a high speed to make contact with the fixed contact 57. When the output lever 15 pressed by the cam 54 rotates, the torsion bar 13 is twisted and energy is stored in the torsion bar 13. Here, by restricting the return of the torsion bar 13 from the twisted state by the latch mechanism, the state in which the movable contact 56 is in contact with the fixed contact 57 can be maintained. Thereafter, by applying torsion to the torsion bar 13 by an electric motor 62, it is possible to move the cam 54 and store energy in the torsion bar 13.

In addition, in the circuit breaker according to the present first embodiment, since opening and closing of the three-phase circuit contacts can be switched by one operating device 52, as compared with a case where an operating device is provided for each phase, miniaturization of the circuit breaker 50 and simplification of the structure can be achieved.

Figure 6:
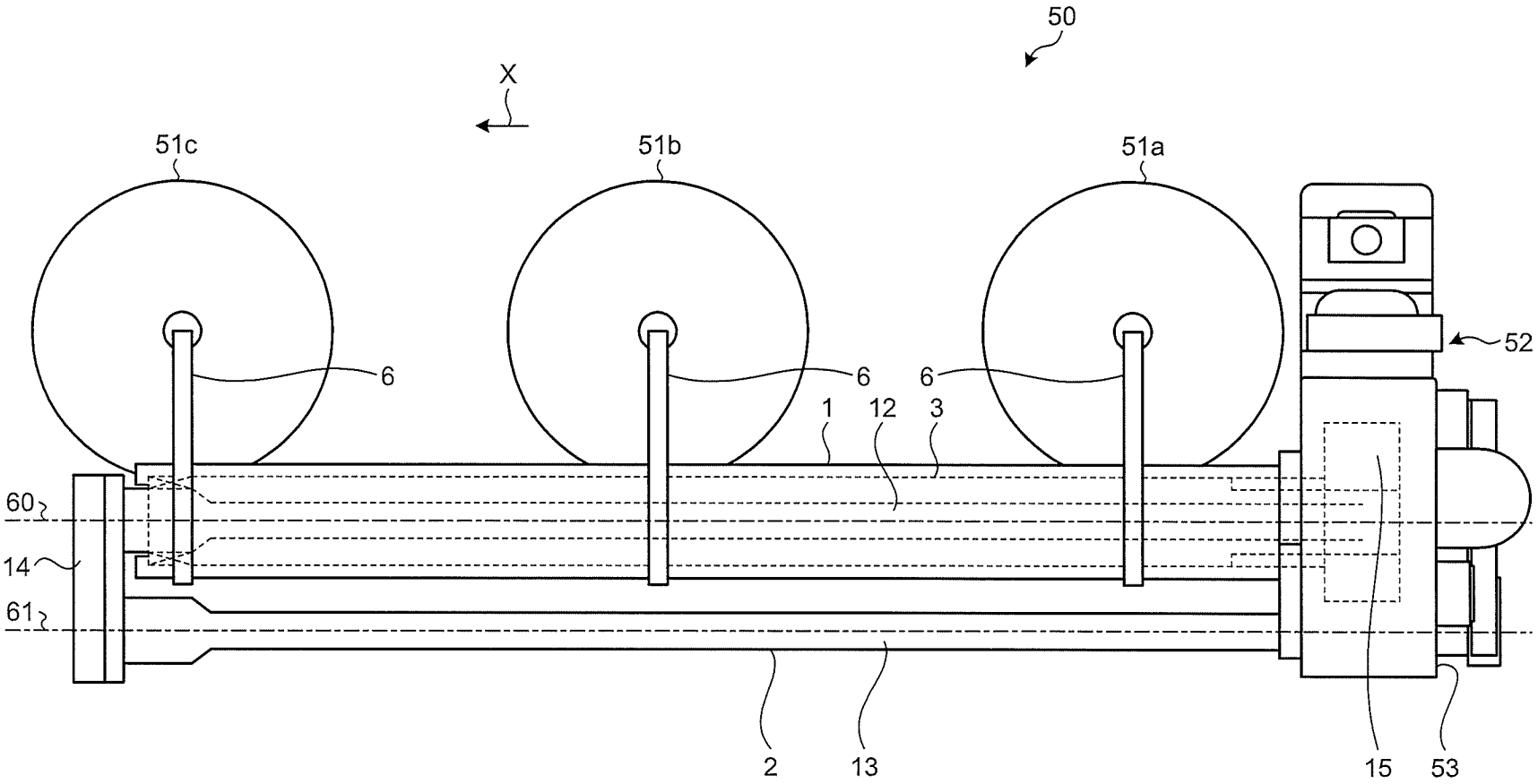
FIG. 6 is a plan view of a circuit breaker according to a first modification of the first embodiment.

FIG. 6 is a plan view of a circuit breaker according to a first modification of the first embodiment. In the first modification, the movable contacts 56 housed in the three tanks 51*a* to 51*c* are operated by the three interlocking levers 6 serving as second levers connected to the drive shaft 3. Therefore, in the first modification, a link mechanism is not connected to the output lever 15. As described above, even when a configuration in which the output lever 15 and the movable contact 56 are not directly connected is adopted, it is possible to switch opening and closing of three-phase circuit contacts by the one operating device 52. Therefore, it is possible to downsize the circuit breaker 50 and simplify the structure as compared with the case where the operating device is provided for each phase. The configuration in the first modification is advantageous in arranging a torsion bar when an overall length of the torsion bar is increased due to requirement of a high output for an operating device.

Figure 7:
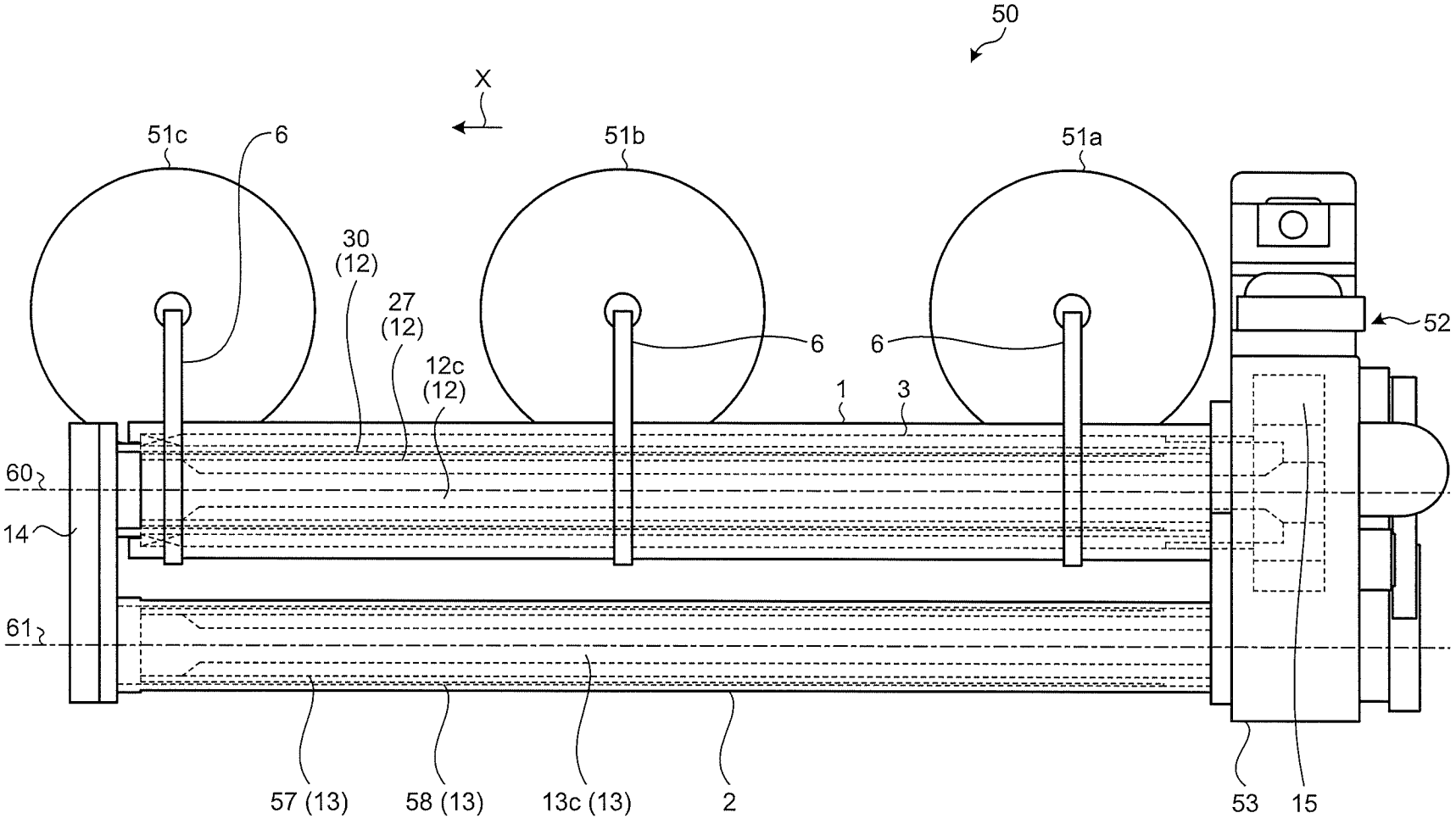
FIG. 7 is a plan view of a circuit breaker according to a second modification of the first embodiment.
Figure 8:
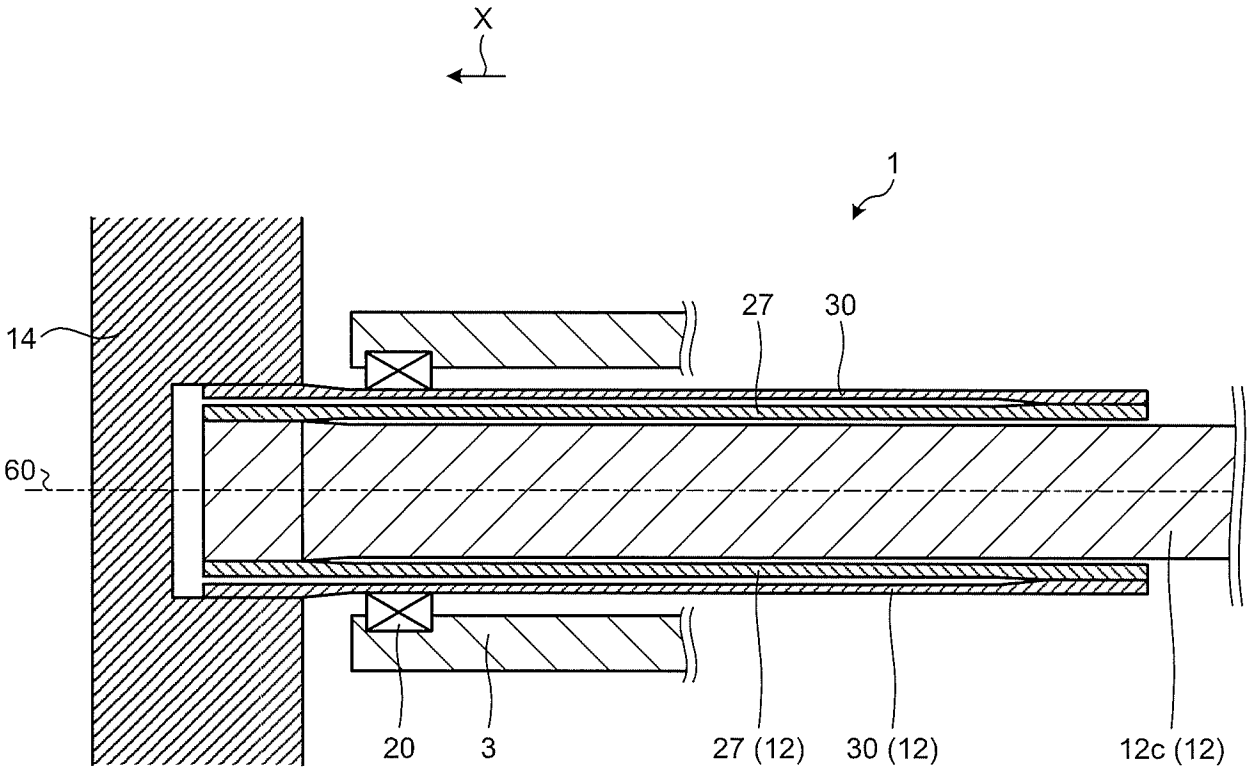
FIG. 8 is a view schematically illustrating a structure of an opening torsion bar of the circuit breaker according to the second modification of the first embodiment.

FIG. 7 is a plan view of a circuit breaker according to a second modification of the first embodiment. FIG. 8 is a view schematically illustrating a structure of the opening torsion bar 1 of the circuit breaker according to the second modification of the first embodiment. In the present second modification, the torsion bar 12 includes an even number of intermediate connecting bars 27 and 30 having cylindrical shapes and provided concentrically around the rotation axis 60 and a center bar 12*c* provided inside the intermediate connecting bars 27 and 30. FIGS. 7 and 8 each illustrate an example in which the two intermediate connecting bars 27 and 30 are provided. The center bar 12*c* has the same configuration as the configuration of the torsion bar 12 illustrated in FIG. 4 except that the center bar 12*c* is not directly fixed to the support 14.

The intermediate connecting bars 27 and 30 have concentric cylindrical shapes centered on the rotation axis 61. The odd-numbered intermediate connecting bar 27 counted from the center bar 12*c* side, that is, from inside, is connected to the center bar 12*c* or the intermediate connecting bar provided inside on one end side on the support 14 side. In addition, the even-numbered intermediate connecting bar 30 counted from the center bar 12*c* side, that is, from the inside, is connected to the intermediate connecting bar 27 provided inside on another end side which is the housing 53 side. Further, the intermediate connecting bar 30 provided on an outermost side is fixed to and supported by the support 14. Further, in other words, in the intermediate connecting bar 27, a connecting part with the bar provided inside and a connecting part provided outside are spaced apart in a direction along the rotation axis 60. Note that the drive shaft 3 is rotatably supported via the bearing 20 with respect to the intermediate connecting bar 30 provided on the outermost side.

In the second modification, since the torsion bar 12 is configured to have a plurality of folds, a length of a twisted portion when the output lever 15 rotates can be increased. Thereby, restoring force from torsion of the torsion bar 12 can be increased. Therefore, it is possible to further speed up operation of the movable contact 56. This makes it possible to apply the operating device 52 to a circuit breaker handling a large current that requires high speed operation.

Further, in the intermediate connecting bars 27 and 30, the intermediate connecting bar 30 provided outside is formed to be thinner than the intermediate connecting bar 27 provided inside. This is because a cross-sectional area for obtaining necessary restoring force is determined in the intermediate connecting bars 27 and 30, and when the intermediate connecting bars 27 and 30 are formed by the cross-sectional area thereof, the intermediate connecting bar 30 disposed outside can be made thinner.

Note that, as illustrated in FIG. 7, also in the closing torsion bar 2, the torsion bar 13 may include intermediate connecting bars 58 and 59 and a center bar 13*c*. Further, in the second modification, an example in which the three interlocking levers 6 are used is illustrated, but as in the example illustrated in FIGS. 1, 2, and 4, it may be configured to use the two interlocking levers 6 by connecting the output lever 15 of the operating device 52 with the movable contact 56 in the tank 51*a* via the link mechanism 4.

Figure 9:
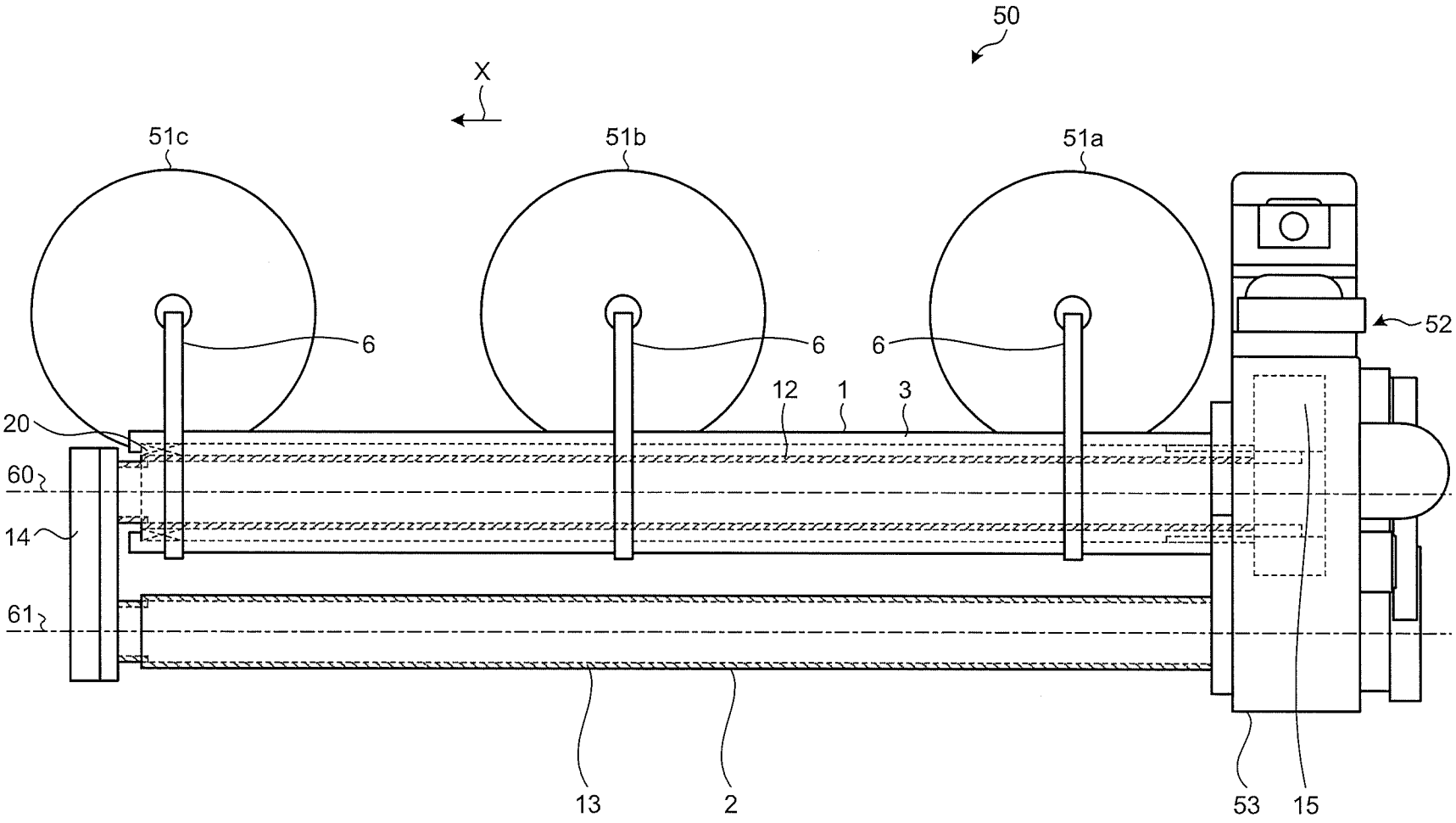
FIG. 9 is a plan view of a circuit breaker according to a third modification of the first embodiment.

FIG. 9 is a plan view of the circuit breaker 50 according to a third modification of the first embodiment. In the present modification, the torsion bar 12 has a tubular shape with the rotation axis 60 as a central axis, and the torsion bar 13 has a tubular shape with the rotation axis 61 as a center. Note that, for ease of understanding of the drawing, the torsion bar 12 and the torsion bar 13 are hatched.

In the third modification, an example in which the three interlocking levers 6 are used is illustrated, but as in the example illustrated in FIGS. 1, 2, and 4, it may be configured to use the two interlocking levers 6 by connecting the output lever 15 of the operating device 52 with the movable contact 56 in the tank 51*a* via the link mechanism 4.

The configuration illustrated in the above embodiment illustrates one example of the contents of the present invention and can be combined with another known technique, and it is also possible to omit and change a part of the configuration without departing from the gist of the present invention.

REFERENCE SIGNS LIST

1 opening torsion bar; 2 closing torsion bar; 3 drive shaft; 4, 5 link mechanism; 6 interlocking lever; 9 mounting seat; 12, 13 torsion bar; 12*c*, 13*c* center bar; support; 15 output lever; 16 opening shaft; 17 contact part; 18 bearing; 19 contact part; 20 bearing; 21 contact part; 22 closing shaft; 23, 24 contact part; closing lever; 26 contact part; 27, 30 intermediate connecting bar; 49 end surface; 50 circuit breaker; 51*a* to 51*c* tank; 52 operating device; 53 housing; 53*a*, 53*b* through hole; 54 cam; 55 abutting part; 56 movable contact; 57 fixed contact; 60, 61 rotation axis; 62 electric motor.

The invention claimed is:

1. An operating device comprising:

a first lever rotatable around a rotation axis;

a shaft having a tubular shape with the rotation axis as a center and connected to the first lever;

a torsion bar having a columnar shape or a tubular shape with the rotation axis as a central axis, provided inside the shaft and connected to the first lever;

a support to fix and support one end of the torsion bar;

a drive shaft having a tubular shape with the rotation axis as a central axis and surrounding a periphery of the torsion bar, one end serving as a side of the first lever being connected to the shaft, and another end opposite to the one end serving as the side of the first lever being rotatably supported around the rotation axis; and a plurality of second levers connected to the drive shaft and rotatable around the rotation axis on a side of the support rather than the shaft, wherein another end of the torsion bar is connected to the shaft.

2. The operating device according to claim 1, wherein the torsion bar is longer than the drive shaft.

3. The operating device according to claim 1, wherein the torsion bar includes an even number of intermediate connecting bars having cylindrical shapes and provided concentrically around the rotation axis and a center bar provided inside the intermediate connecting bars, an intermediate connecting bar disposed on an outermost side is fixed to and supported by the support, and in one of the intermediate connecting bars, a connecting part with the center bar disposed inside the one of the intermediate connecting bars or another of the intermediate connecting bars disposed inside the one of the intermediate connecting bars and a connecting part with another of the intermediate connecting bars disposed outside the one of the intermediate connecting bars or the support disposed outside the one of the intermediate connecting bars are separated in a direction along the rotation axis.

4. A circuit breaker comprising:

the operating device according to claim 1; and three-phase circuit contacts, wherein two second levers are provided, and each of the first lever and the second levers is connected to one of the circuit contacts in each of different phases.

5. A circuit breaker comprising:

the operating device according to claim 1; and three-phase circuit contacts, wherein three second levers are provided, and each of the second levers is connected to one of the circuit contacts in each of different phases.

6. An operating device comprising:

a first lever rotatable around a rotation axis;

a shaft having a tubular shape with the rotation axis as a center and connected to the first lever;

a torsion bar having a columnar shape or a tubular shape with the rotation axis as a central axis, provided inside the shaft and connected to the first lever;

a support to fix and support one end of the torsion bar;

a drive shaft having a tubular shape with the rotation axis as a central axis and surrounding a periphery of the torsion bar, one end serving as a side of the first lever being connected to the shaft, and another end opposite to the one end serving as the side of the first lever being rotatably supported around the rotation axis; and a plurality of second levers connected to the drive shaft and rotatable around the rotation axis on a side of the support rather than the shaft, wherein the torsion bar includes an even number of intermediate connecting bars having cylindrical shapes and provided concentrically around the rotation axis and a center bar provided inside the intermediate connecting bars, an intermediate connecting bar disposed on an outermost side is fixed to and supported by the support, and in one of the intermediate connecting bars, a connecting part with the center bar disposed inside the one of the intermediate connecting bars or another of the intermediate connecting bars disposed inside the one of the intermediate connecting bars and a connecting part with another of the intermediate connecting bars disposed outside the one of the intermediate connecting bars or the support disposed outside the one of the intermediate connecting bars are separated in a direction along the rotation axis.

* * * * *